US007221325B2

(12) United States Patent
Ide

(10) Patent No.: US 7,221,325 B2
(45) Date of Patent: May 22, 2007

(54) ANTENNA SYSTEM AND PORTABLE RADIO DEVICE

(75) Inventor: Yoshiyuki Ide, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 11/200,300

(22) Filed: Aug. 10, 2005

(65) Prior Publication Data

US 2006/0049994 A1 Mar. 9, 2006

(30) Foreign Application Priority Data

Sep. 8, 2004 (JP) ..... 2004-260513

(51) Int. Cl.
*H01Q 1/24* (2006.01)

(52) U.S. Cl. ..... 343/702; 343/700 MS

(58) Field of Classification Search ..... 343/895, 343/702, 725, 700 MS
See application file for complete search history.

(56) References Cited

U.S. PATENT DOCUMENTS

| | | | | |
|---|---|---|---|---|
| 6,198,442 | B1 | 3/2001 | Rutkowski et al. | |
| 6,388,625 | B1 * | 5/2002 | Fukushima et al. | 343/702 |
| 6,388,626 | B1 | 5/2002 | Gamalielsson et al. | |
| 6,459,413 | B1 * | 10/2002 | Tseng et al. | 343/702 |
| 6,693,604 | B2 * | 2/2004 | Washiro et al. | 343/895 |
| 6,888,514 | B2 * | 5/2005 | Sheng-Gen et al. | 343/895 |
| 6,900,768 | B2 * | 5/2005 | Iguchi et al. | 343/702 |

FOREIGN PATENT DOCUMENTS

| | | |
|---|---|---|
| JP | 2000-31721 | 1/2000 |
| JP | 2000-031721 | 1/2000 |
| JP | 2002-319816 | 10/2002 |
| WO | WO 03/067703 A1 | 8/2003 |

OTHER PUBLICATIONS

European Search Report issued Nov. 11, 2005.

* cited by examiner

*Primary Examiner*—Hoang V. Nguyen
(74) *Attorney, Agent, or Firm*—Dickstein Shapiro LLP

(57) ABSTRACT

An object of the present invention is to secure good communication quality in a small-housing portable radio in which an antenna system having two antenna elements for providing for multi-frequency-bands is built. A substrate on which a high-frequency circuit and an earth plate are mounted and an antenna system is built in the housing of a portable radio device. A shorter coil element of two coil elements is set so that the direction of the antenna current is vertical to one side of a substrate and the longer coil element is set so that the direction of the antenna current is parallel with the side. Therefore, it is possible to set two coil elements in a small space in a housing after setting the substrate while directions of the antenna currents of the coil elements are orthogonal to each other (while mutual interference between the elements is small). Therefore, it is possible to secure good communication quality even for a small-housing portable radio device.

7 Claims, 5 Drawing Sheets

ANTENNA SYSTEM AND PORTABLE RADIO DEVICE

BACKGROUND OF THE INVENTION

1. Field of the Invention

The present invention relates to a built-in-type antenna system to be mounted on a portable radio device such as a cell phone, and more particularly, to an antenna system having two elements for providing for multi-frequency-bands (hereinafter referred to as multibands).

2. Description of the Prior Art

When using a built-in-type antenna system for a compact portable radio device such as a cellphone, a mounting method thereof becomes a problem. Particularly, in the case of an antenna system having two elements for providing for multibands, its mounting method becomes a problem because the occupying portion of the system requires a large area.

Various methods are considered to mount an antenna system having two elements for providing for a multiband in the housing of a portable radio.

For example, as shown in FIGS. 6 to 8, methods for proximity-arranging two antenna elements are considered.

In FIG. 6, two coil elements 111 and 112 having element lengths different from each other are horizontally arranged. In FIG. 7, two coil elements 111 and 112 having element lengths different from each other are arranged so that they are vertically superimposed. Moreover, in FIG. 8, a coil element 111 and a linear element 132 having element lengths different from each other are horizontally arranged. Arrows in FIG. 6 to 8 show directions of antenna current.

When proximity-arranging two elements, these arrangements as shown in FIGS. 6 to 8 are advantageous for a circuit because it is possible to join one ends of these two elements and unite feeding points into one. However, in any case of FIGS. 6 to 8, because two elements are arranged in the same direction, there is a problem that communication performance is deteriorated due to the mutual interference between the elements.

To solve the above problem, a method for arranging two elements at positions as separate from each other as possible in a housing is also considered. However, this method is disadvantageous for a circuit because it is difficult to unite feeding point into one.

To solve the above problem, an antenna system is proposed in which two elements are proximity-arranged so that central axes of the elements become orthogonal to each other (refer to Patent Documents 1 and 2).

[Patent Document 1] Japanese Patent Laid-Open No. 2000-31721

[Patent Document 2] Japanese Patent Laid-Open No. 2002-319816

BRIEF SUMMARY OF THE INVENTION

As described above, by orthogonally arranging two elements, it is possible to eliminate mutual interference and keep good communication performance. Moreover, because proximity-arranging elements, it is possible to unite feeding points into one.

A substrate on which not only an antenna system but also various circuits such as a high-frequency circuit and CPU are mounted, is housed in the housing of a portable radio. Therefore, when arranging two elements of an antenna system in a small space in the housing after mounting the substrate, it is necessary to consider not only the arrangement relation between elements but also the arrangement relation between the elements and the substrate. However, the above prior art does not consider the arrangement relation between the elements and the substrate at all.

Therefore, it is an object of the present invention to provide an antenna system and a portable radio device which can be mounted while orthogonally arranging two elements in a small space in a housing after setting a substrate by considering not only the arrangement relation between elements but also the arrangement relation between the elements and the substrate.

A first antenna system of the present invention is an antenna system to be mounted on a portable radio device in order to achieve the above object, which has a first antenna element and a second antenna element longer than the first element and in which the first antenna element is set so that the direction of the antenna current of the first element becomes vertical to one side of a substrate of the portable radio, and the second antenna element is set so that the direction of the antenna current of the second antenna element becomes parallel with the one side.

A second antenna system of the present invention uses the first antenna system in which the first antenna element and the second antenna element are joined at a joining portion and the joining portion is electrically connected with a feeding point, to provide one feeding point and a simple circuit configuration.

A third antenna system of the present invention uses the first or second antenna system in which the first antenna element and the second antenna element are coil elements.

A fourth antenna system of the present invention uses the first or second antenna system in which the first antenna element and the second antenna element are meander elements.

A fifth antenna system of the present invention uses the first or second antenna system in which either of the first antenna element and second antenna element is a coil element and the other of them is a meander element.

A first portable radio of the present invention is a portable radio device in which an antenna system including a first antenna element and a second antenna element longer than the first antenna element is mounted in a housing so that an antenna system constituted by orthogonally arranging two elements can be mounted even if the housing is downsized, the first element is set so that the direction of the antenna current of the first antenna element becomes vertical to one side of a substrate to be mounted in the housing, and the second antenna element is set so that the direction of the antenna current of the second antenna element becomes parallel with one side of the substrate.

A second portable radio device of the present invention uses the first portable radio in which the first antenna element and the second antenna element are joined at a joining portion and the joining portion is electrically connected with the feeding point, to provide one feeding point and a simple circuit configuration.

DETAILED DESCRIPTION OF THE PREFERRED EMBODIMENTS

Then, embodiments of the present invention are described below by referring to the accompanying drawings.

Figure 1:
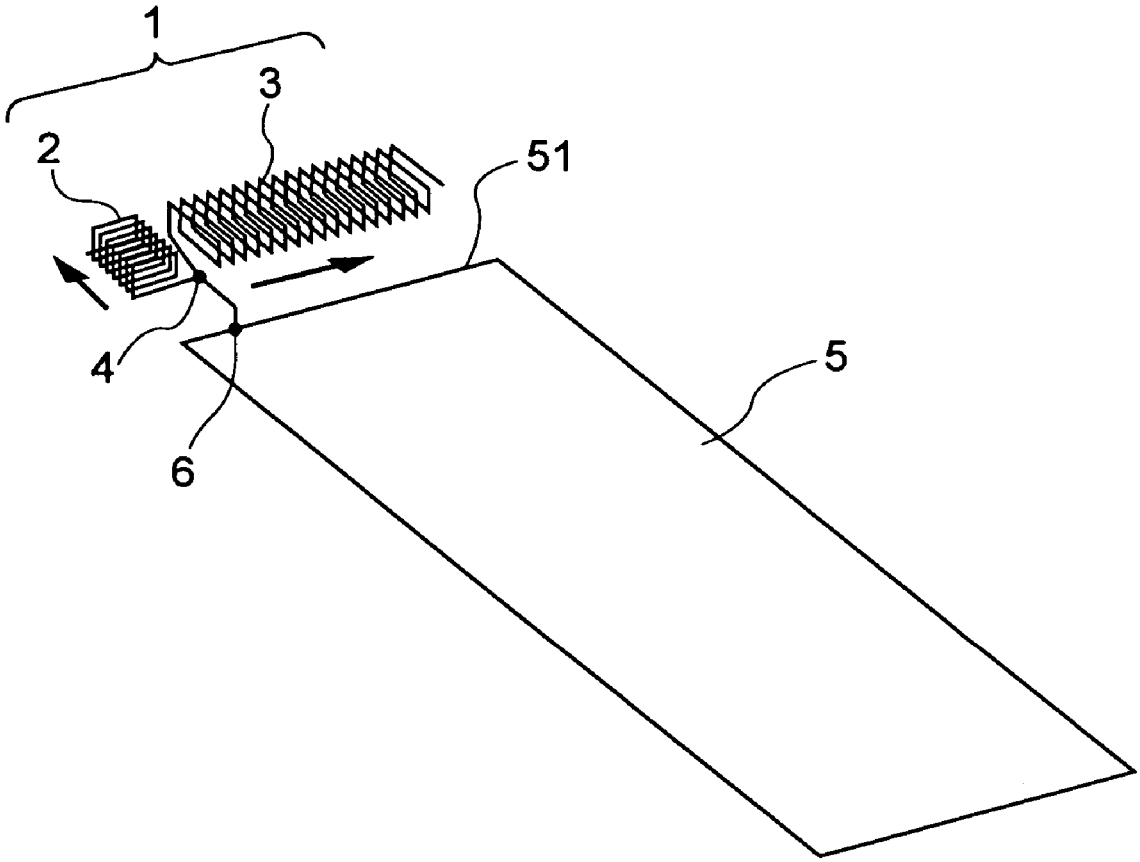
FIG. 1 is a perspective view showing a configuration of first embodiment of an antenna system of the present invention.

FIG. 1 is a perspective view showing a configuration of first embodiment of an antenna system of the present invention.

When referring to FIG. 1, it is found that an antenna system 1 is constituted of a high-frequency-band coil element 2 having an element length of L2 and a low-frequency-band coil element 3 having an element length of L3 (L2<L3).

These two coil elements 2 and 3 are arranged as closely to each other as possible and their one ends are joined at a joining portion 4. Moreover, the joining portion 4 is electrically connected with one feeding point 6 formed on a rectangular substrate 5. Though not illustrated in FIG. 1, electronic components such as a high-frequency circuit and a CPU and an earth plate are mounted on the substrate 5.

The coil element 2, which is shorter than the coil element 3, is fixed in the housing (not illustrated) of a portable radio device so that the direction of the antenna current (direction shown by an arrow in FIG. 1) of the coil element 2 is orthogonal to a side 51 of the substrate 5 and longer coil element 3 is fixed in the housing so that the direction of the antenna current of the coil element 3 is parallel with the side 51.

Therefore, because the coil elements 2 and 3 are arranged in the housing so that directions of the antenna currents are orthogonal to each other, it is possible to eliminate mutual interference and keep good communication performance. It is allowed to use the side 51 for any one of four sides of the substrate 5. For example, when the substrate 4 is mounted on the housing of the portable radio device, it is possible to use the side 51 as an upper side. Moreover, the coil elements 2 and 3 are arranged at positions which are not overlapped with the substrate 5. By this, the housing of the portable radio device can be thin.

Figure 2A:
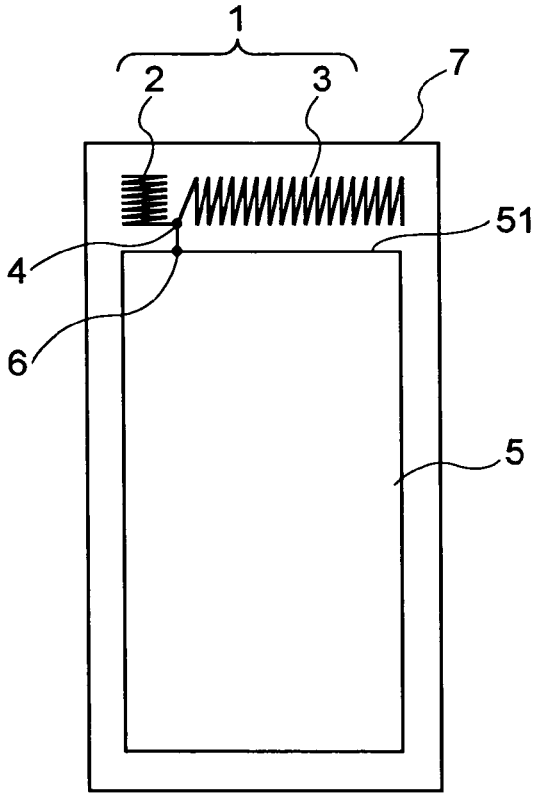
FIGS. 2A and 2B are illustrations for explaining advantages of the first embodiment.

FIG. 2A is an illustration showing a state when mounting the antenna system 1 shown in FIG. 1 in the housing 7 of the portable radio device. When referring to FIG. 2A, it is found that two coil elements 2 and 3 are orthogonally arranged in a small space after setting the substrate 5 in the housing 7. Thus, according to the antenna system 1 of this embodiment considering the arrangement relation with the substrate 5, it is possible to orthogonally arrange these two coil elements 2 and 3 in a small space in the housing 7 after setting the substrate 5.

Figure 2B:
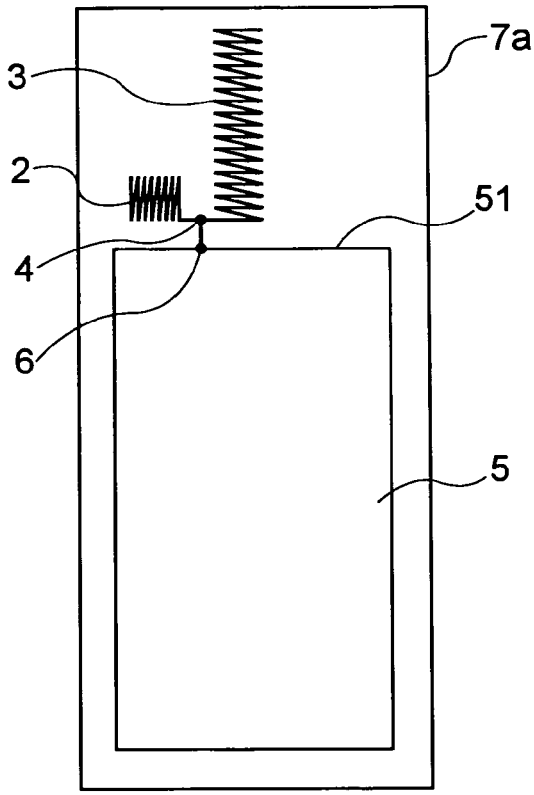

On the other hand, when not setting the arrangement relation between the coil elements 2 and 3 and the substrate 5 like this embodiment, (for example, when arranging the coil element 2 in parallel with the side 51 and the coil element 3 vertically to the side 51), the mounted state of the antenna system is shown in FIG. 2B. As a result of comparing FIGS. 2A and 2B, it is found that a housing 7*a* which is larger than the housing 7 is necessary in order to orthogonally arrange these two coil elements 2 and 3.

Figure 3:
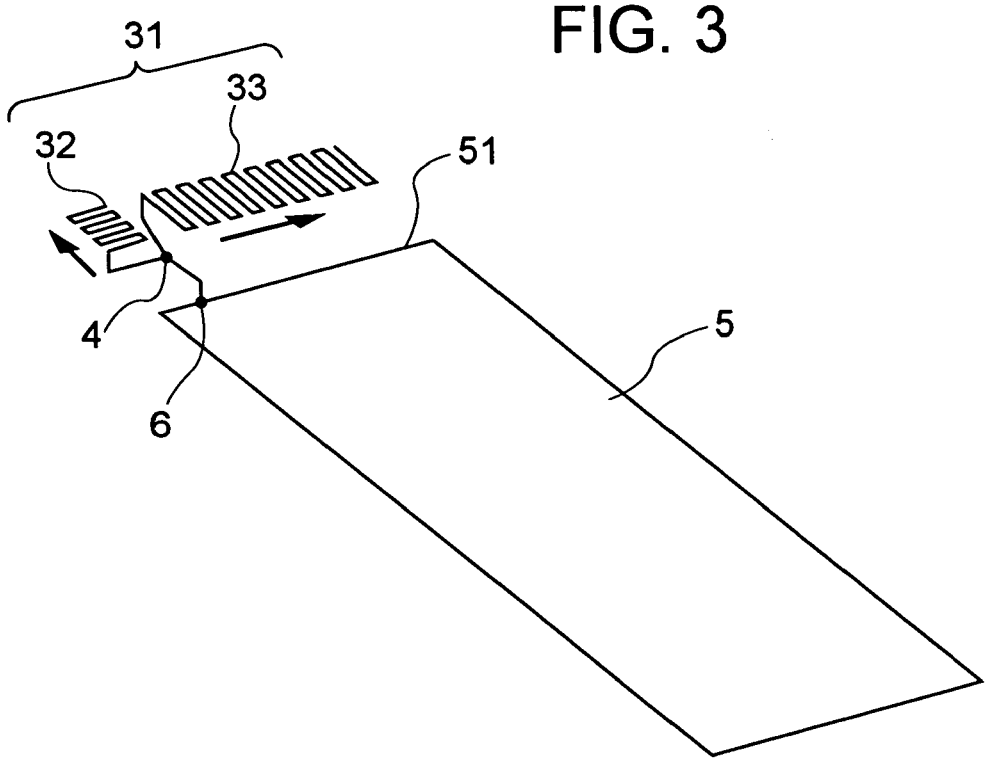
FIG. 3 is a perspective view showing a configuration of second embodiment of an antenna system of the present invention.

FIG. 3 is a perspective view showing a configuration of second embodiment of an antenna system of the present invention.

When referring to FIG. 3, it is found that an antenna system 31 is constituted of a high-frequency-band meander element 32 having an element length of L32 and a low-frequency-band meander element 33 having an element length of L33 (L32<L33).

These two meander elements 32 and 33 are joined each other at a joining portion 4 which is an end of the elements 32 and 33 and the joining portion 4 is electrically connected with the feeding point 6 formed on the substrate 5.

Moreover, the shorter meander element 32 is fixed to the housing of a portable radio device so that the direction of the antenna current is orthogonal to the side 51 of the substrate 5, and the longer meander element 33 is fixed to the housing so that the direction of the antenna current is parallel with the side 51. Therefore, the second embodiment makes it possible to realize an antenna system constituted by orthogonally arranging two elements in a small space in a housing after setting substrate similarly to the case of the first embodiment.

Figure 4:
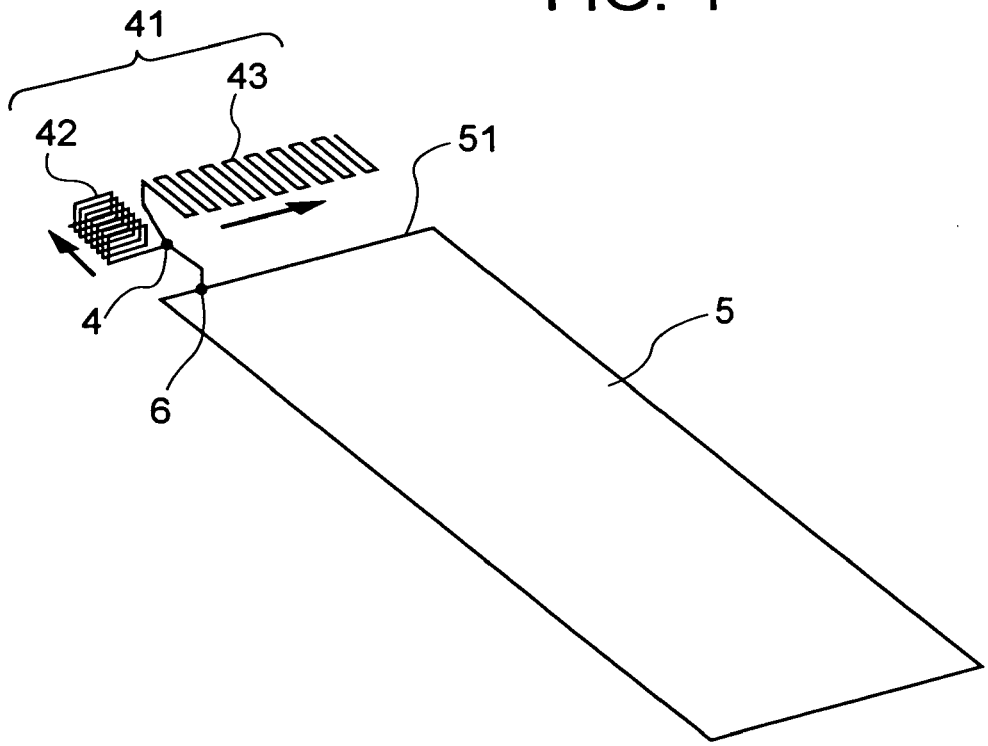
FIG. 4 is a perspective view showing a configuration of third embodiment of an antenna system of the present invention.

FIG. 4 is a perspective view showing a configuration of third embodiment of an antenna system of the present invention.

When referring to FIG. 4, it is found that an antenna system 41 is constituted of a coil element 42 having an element length of L42 and a meander element 43 having an element length of L43 (L42<L43).

These two elements 42 and 43 are joined at the joining portion 4 which is an end of them and the joining portion 4 is electrically connected with the feeding point 6 formed on the substrate 5.

Moreover, the shorter coil element 42 is fixed to the housing of a portable radio so that the direction of the antenna current is orthogonal to the side 51 of the substrate 5, and the longer meander element 43 is fixed to the housing so that the direction of the antenna current is parallel with the side 51. Therefore, the third embodiment also makes it possible to mount an antenna system constituted by orthogonally arranging two elements in a small space in a housing after setting a substrate similarly to the case of the first embodiment.

Figure 5:
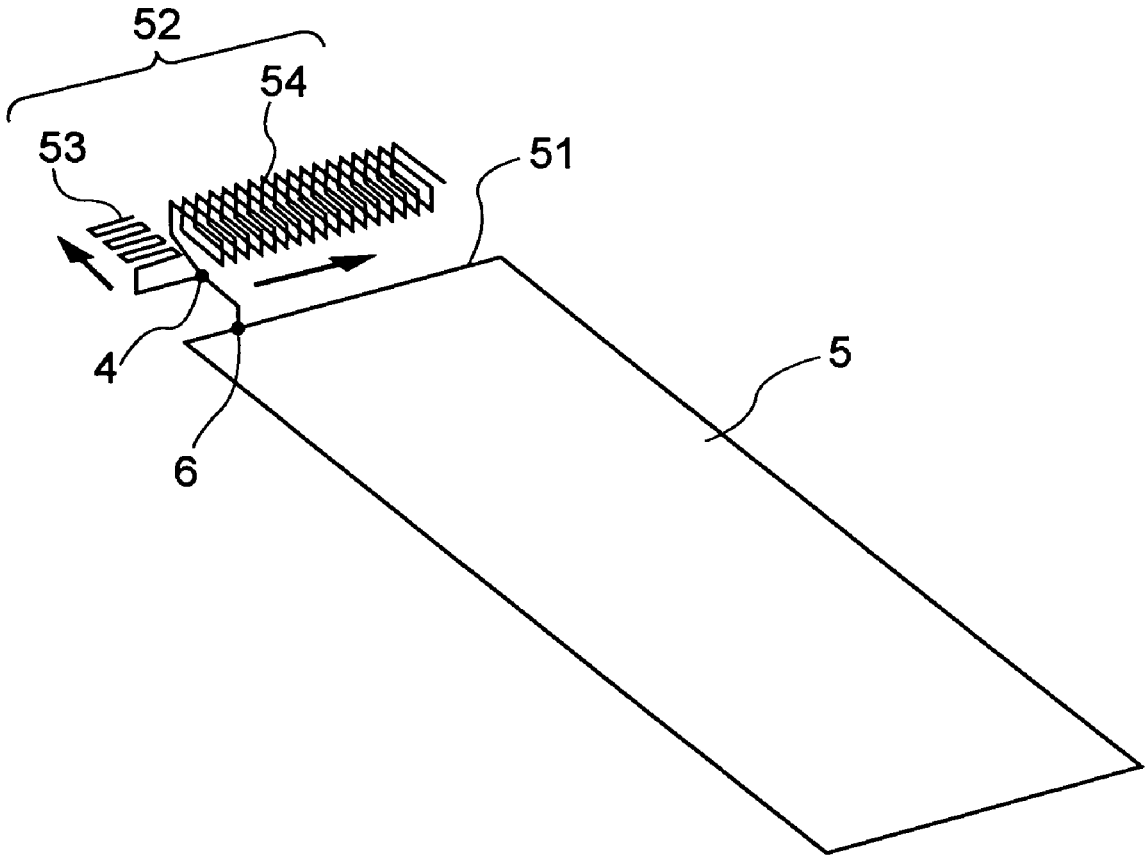
FIG. 5 is a perspective view showing a configuration of fourth embodiment of an antenna system of the present invention.
Figure 6:
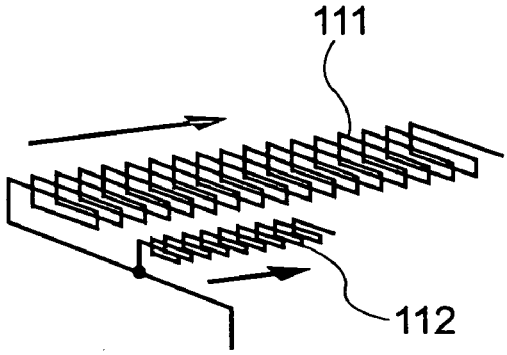
FIG. 6 is a perspective view showing a generally-considered antenna system corresponding to a multiband.
Figure 7:
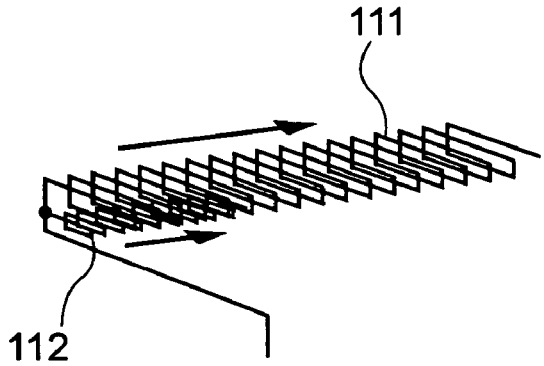
FIG. 7 is a perspective view showing generally-considered another antenna system corresponding to a multiband.
Figure 8:
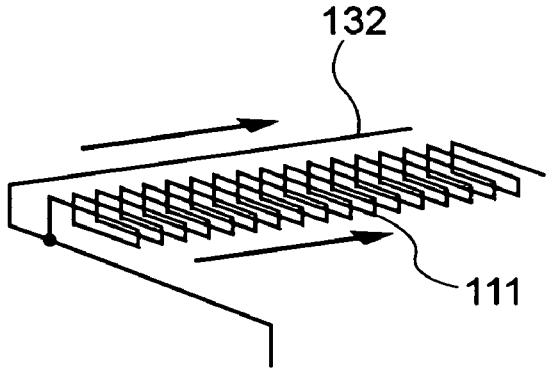
FIG. 8 is a perspective view showing still another generally-considered antenna system corresponding to a multiband.

FIG. 5 is a perspective view showing a configuration of fourth embodiment of an antenna system of the present invention.

When referring to FIG. 5, it is found that an antenna system 52 is constituted of a meander element 53 having an element length of L53 and a coil element 54 having an element length of L54 (L53<L54).

These two elements 53 and 54 are joined at the joining portion 4 which is an end of them and the joining portion 4 is electrically connected with the feeding point 6 formed on the substrate 5.

Moreover, the shorter meander element 53 is fixed to a housing so that the direction of the antenna current is orthogonal to the side 51 of the substrate 5, and the longer coil element 54 is fixed to the housing so that the direction of the antenna current is parallel with the side 51. Therefore, the fourth embodiment also makes it possible to mount an antenna system constituted by orthogonally arranging two elements in a small space in the housing after setting substrate similarly to the case of the first embodiment.

According to the present invention, a shorter first antenna element of first and second antenna elements is set so that the direction of the antenna current becomes vertical to one side of a substrate and a longer second antenna element is set so that the direction of the antenna current becomes parallel with the one side. Therefore, it is possible to arrange the first and second antenna elements in a small space in a housing after setting the substrate so that the first and second antenna elements are orthogonal (that is, mutual interference is small). As a result, it is possible to obtain good communication quality even if using a small housing.

According to the present invention, because first and second antenna elements are joined at a joining portion and the joining portion is electrically connected with feeding points, it is possible to unite the feeding points into one. As a result, it is possible to simplify a circuit configuration.

What is claimed is:

1. An antenna system to be mounted on a portable radio device, comprising:

a first antenna element; and a second antenna element longer than the first element; wherein the first antenna element is set so that the direction of the antenna current of the first antenna element is vertical to one side of a substrate of the portable radio device, and the second antenna element is set so that the direction of the antenna current of the second antenna element is parallel with the one side, the first and second antenna elements being arranged at positions which are not overlapped by the substrate.

2. The antenna system according to claim 1, wherein the first antenna element and the second antenna element are joined at a joining portion and the joining portion is electrically connected with a feeding point.

3. The antenna system according to claim 1, wherein the first antenna element and the second antenna element are coil elements.

4. The antenna system according to claim 1, wherein the first antenna element and the second antenna element are meander elements.

5. The antenna system according to claim 1, wherein either of the first antenna element and the second antenna element is a coil element and the other element is a meander element.

6. A portable radio device having an antenna system including a first antenna element and a second antenna element longer than the first antenna element in the housing of the portable radio device, wherein the first antenna element is set so that the direction of the antenna current of the first antenna element becomes vertical to one side of a substrate to be mounted in the housing, and the second antenna element is set so that the direction of the antenna current of the second antenna element becomes parallel with one side of the substrate, the first and second antenna elements being arranged at positions which are not overlapped by the substrate.

7. The portable radio device according to claim 6, wherein the first antenna element and the second antenna element are joined at a joining portion and the joining portion is electrically connected with a feeding point.

* * * * *